US008261555B2

(12) United States Patent
Uhm et al.

(10) Patent No.: US 8,261,555 B2
(45) Date of Patent: Sep. 11, 2012

(54) INJECTION NOZZLE FOR A TURBOMACHINE

(75) Inventors: Jong Ho Uhm, Simpsonville, SC (US); Thomas Edward Johnson, Greer, SC (US); Kwanwoo Kim, Greer, SC (US)

(73) Assignee: General Electric Company, Schenectady, NY (US)

( * ) Notice: Subject to any disclaimer, the term of this patent is extended or adjusted under 35 U.S.C. 154(b) by 162 days.

(21) Appl. No.: 12/832,330

(22) Filed: Jul. 8, 2010

(65) Prior Publication Data

US 2012/0006030 A1 Jan. 12, 2012

(51) Int. Cl.
*F02C 1/00* (2006.01)
*F02G 3/00* (2006.01)

(52) U.S. Cl. ..... 60/746; 60/804; 60/747; 60/760; 60/752; 60/737

(58) Field of Classification Search ..... 60/804, 60/746, 747, 760, 752, 737
See application file for complete search history.

(56) References Cited

U.S. PATENT DOCUMENTS

| | | | | |
|---|---|---|---|---|
| 4,100,733 | A | 7/1978 | Striebel et al. | |
| 6,267,585 | B1 | 7/2001 | Suttrop | |
| 6,928,823 | B2 | 8/2005 | Inoue et al. | |
| 7,343,745 | B2 * | 3/2008 | Inoue et al. | 60/737 |
| 7,426,833 | B2 * | 9/2008 | Yoshida et al. | 60/737 |
| 7,631,499 | B2 | 12/2009 | Bland | |
| 2004/0000146 | A1 | 1/2004 | Inoue et al. | |
| 2008/0229755 | A1 * | 9/2008 | Koganezawa et al. | 60/775 |
| 2008/0268387 | A1 * | 10/2008 | Saito et al. | 431/8 |
| 2009/0293484 | A1 * | 12/2009 | Inoue et al. | 60/740 |

OTHER PUBLICATIONS

Extended European Search Report for EP Application No. 11173161.8-2301, dated Mar. 23, 2012, pp. 1-6.

* cited by examiner

*Primary Examiner* — William H Rodriguez
*Assistant Examiner* — Craig Kim
(74) *Attorney, Agent, or Firm* — Cantor Colburn LLP

(57) ABSTRACT

A turbomachine includes a compressor, a combustor operatively connected to the compressor, an end cover mounted to the combustor, and an injection nozzle assembly operatively connected to the combustor. The injection nozzle assembly includes a first end portion that extends to a second end portion, and a plurality of tube elements provided at the second end portion. Each of the plurality of tube elements defining a fluid passage includes a body having a first end section that extends to a second end section. The second end section projects beyond the second end portion of the injection nozzle assembly.

28 Claims, 7 Drawing Sheets

INJECTION NOZZLE FOR A TURBOMACHINE

FEDERAL RESEARCH STATEMENT

This invention was made with Government support under Contract No. DE-FC26-05NT42643, awarded by the US Department of Energy (DOE). The Government has certain rights in this invention.

BACKGROUND OF THE INVENTION

The subject matter disclosed herein relates to the art of turbomachines and, more particularly, to an injection nozzle for a turbomachine.

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. One method of achieving low NOx levels is to ensure good mixing of fuel and air prior to combustion. Moreover, when using pure $H_2$ or high $H_2$ combustion, fuel jet penetration is not sufficient to mix with available air. As such fuel will flow through a boundary layer in a premixer tube portion of the injector. This fuel behavior results in a flashback condition that limits an overall operational range of the turbomachine.

BRIEF DESCRIPTION OF THE INVENTION

According to one aspect of the invention, a turbomachine includes a compressor, a combustor operatively connected to the compressor, an end cover mounted to the combustor, and an injection nozzle assembly operatively connected to the combustor. The injection nozzle assembly includes a first end portion that extends to a second end portion, and a plurality of tube elements provided at the second end portion. Each of the plurality of tube elements defines a fluid passage that includes a body having a first end section that extends to a second end section. The second end section projects beyond the second end portion of the injection nozzle assembly.

According to another aspect of the invention, an injection nozzle assembly for a turbomachine includes a first end portion that extends to a second end portion, and a plurality of tube elements provided at the second end portion. Each of the plurality of tube elements defines a fluid passage that includes a body having a first end section that extends to a second end section. The second end section projects beyond the second end portion of the injection nozzle assembly.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
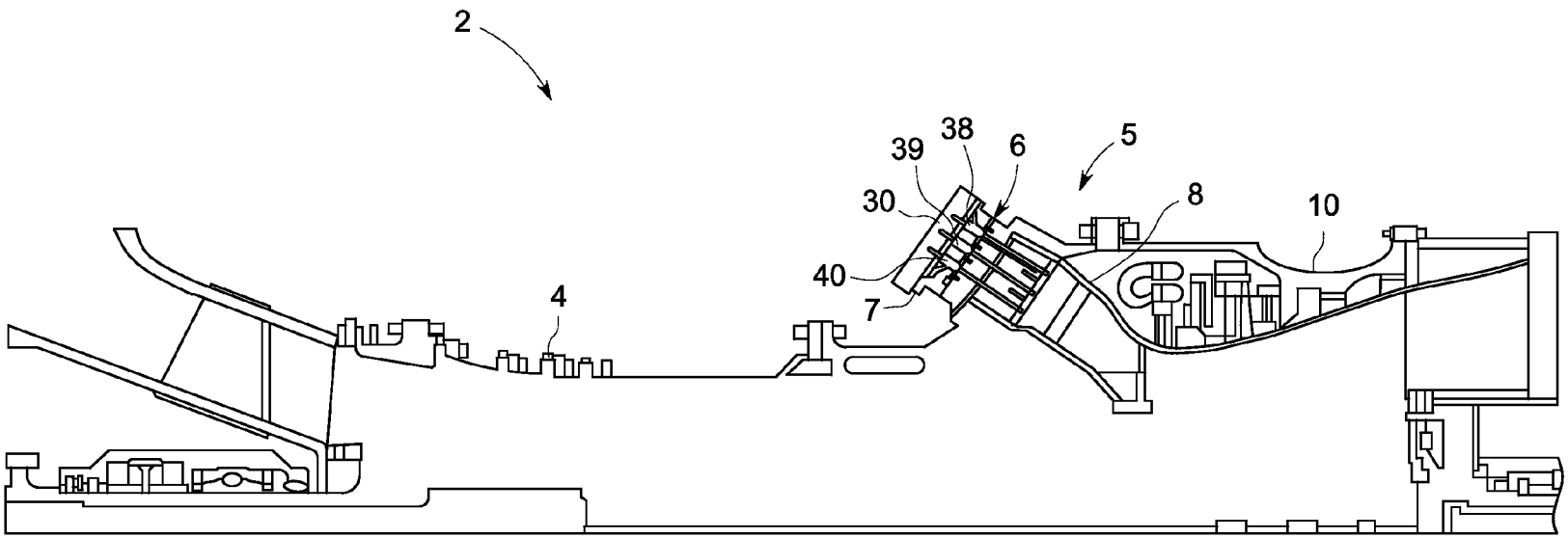
FIG. 1 is a cross-sectional side view of an exemplary turbomachine including a multi-tube nozzle constructed in accordance with an exemplary embodiment.

With initial reference to FIG. 1, a turbomachine constructed in accordance with exemplary embodiments is indicated generally at 2. Turbomachine 2 includes a compressor 4 and a combustor assembly 5 having at least one combustor 6 provided with a fuel nozzle or injector assembly housing 8. Turbomachine 2 also includes a turbine 10. In one embodiment, turbomachine 2 is a heavy duty gas turbine engine, however, it should be understood that the exemplary embodiments are not limited to any one particular engine configuration and may be used in connection with a variety of other gas turbine engines.

Figure 2:
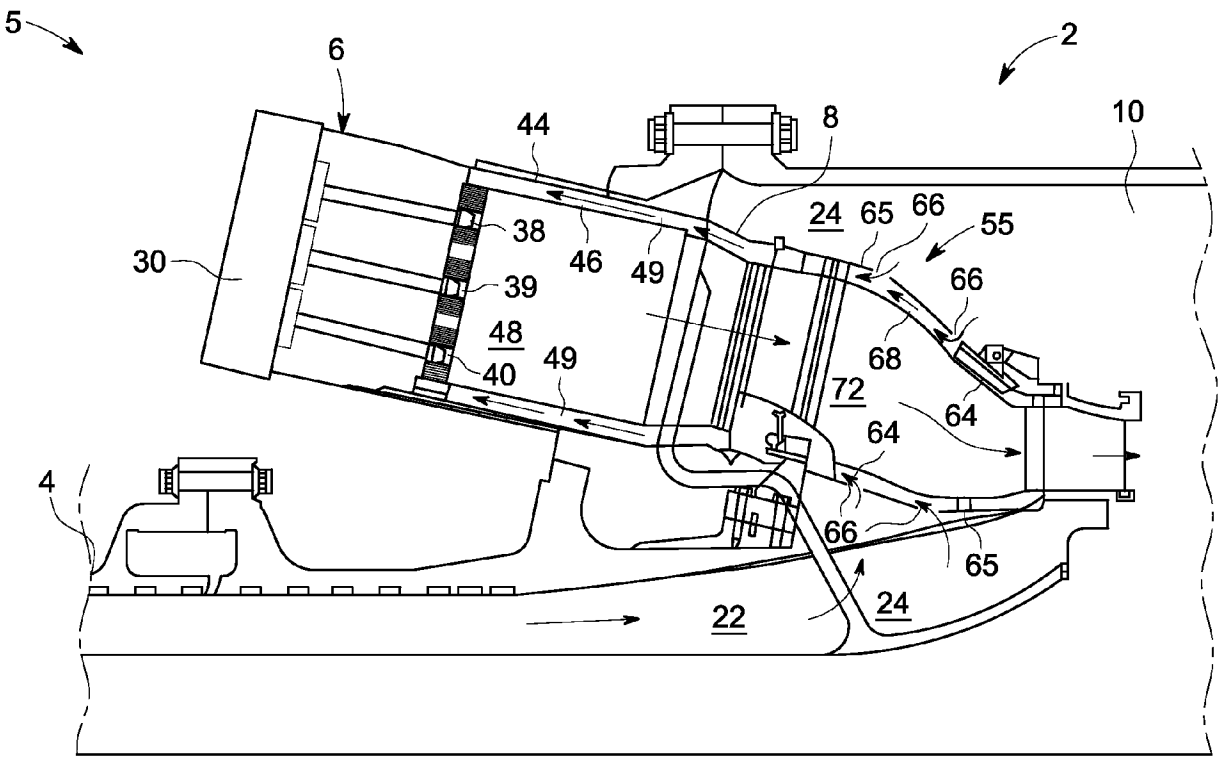
FIG. 2 is a cross-sectional view of a combustor portion of the exemplary turbomachine of FIG. 1.

As best shown in FIG. 2, combustor 6 is coupled in flow communication with compressor 4 and turbine 10. Compressor 4 includes a diffuser 22 and a compressor discharge plenum 24 that are coupled in flow communication with each other. Combustor 6 also includes an end cover 30 positioned at a first end thereof. As will be discussed more fully below, end cover 30 supports a plurality of injection nozzle assemblies, three of which are indicated at 38-40. Combustor 6 further includes a combustor casing 44 and a combustor liner 46. As shown, combustor liner 46 is positioned radially inward from combustor casing 44 so as to define a combustion chamber 48. An annular combustion chamber cooling passage 49 is defined between combustor casing 44 and combustor liner 46. A transition piece 55 couples combustor 6 to turbine 10. Transition piece 55 channels combustion gases generated in combustion chamber 48 downstream towards a first stage turbine nozzle (not shown). Towards that end, transition piece 55 includes an inner wall 64 and an outer wall 65.

Outer wall 65 includes a plurality of openings 66 that lead to an annular passage 68 defined between inner wall 64 and outer wall 65. Inner wall 64 defines a guide cavity 72 that extends between combustion chamber 48 and turbine 10.

During operation, air flows through compressor 4 and compressed air is supplied to combustor 6 and, more specifically, to injector assemblies 38, 39, and 40. At the same time, fuel is passed to injector assemblies 38-40 to mix with the air and form a combustible mixture. Of course it should be understood that combustor 6 may include additional injector nozzle assemblies (not shown) and turbomachine 2 may include additional combustors (also not shown). In any event, the combustible mixture is channeled to combustion chamber 48 and ignited to form combustion gases. The combustion gases are then channeled to turbine 10. Thermal energy from the combustion gases is converted to mechanical, rotational energy.

At this point it should be understood that the above-described construction is presented for a more complete understanding of the exemplary embodiments, which are directed to the particular structure of injection nozzle assemblies 38-40. However, as each injection nozzle assembly 38-40 is similar, a detailed description will follow with reference to injection nozzle assembly 38 with an understanding that injection nozzle assemblies 39 and 40 include similar structure.

Figure 3:
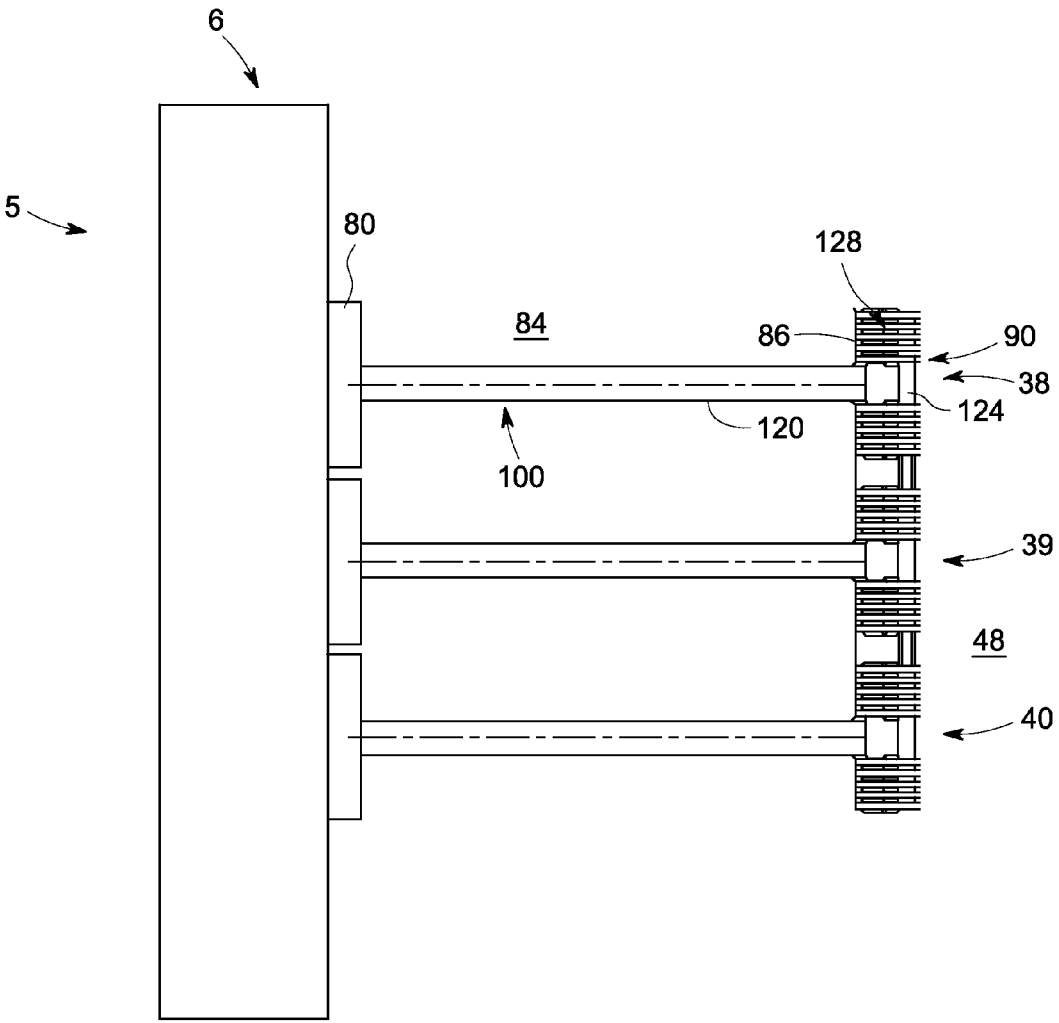
FIG. 3 is a partial cross-sectional side view of the combustor portion of FIG. 2 including a plurality of injection nozzle assemblies in accordance with an exemplary embodiment.

As shown in FIG. 3, injection nozzle assembly 38 includes a first end portion or fuel inlet 80 that extends to a second end portion or circumferential wall 82 through a plenum 84 having an end wall 86. Injection nozzle assembly 38 also includes a plurality of tube elements, one of which is indicated generally at 90, arranged in a number of rows that extend radially about circumferential wall 82. As will be discussed more fully below, tube elements 90 receive fuel from a fuel inlet tube 100 that extends through injection nozzle assembly 38 from end cover 30 (FIG. 2), to a conduit 120, and then on to a central receiving port 124. Then the fuel fills upstream fuel delivery plenum 128 in injection nozzle assembly 38 and is distributed to each of the plurality of tube elements 90 before being mixed with air and introduced to combustion chamber 48. In accordance with one aspect of the exemplary embodiment, upstream fuel delivery plenum 128 is defined by a gap that exists between adjacent tube elements 90. With this arrangement, the fuel cools down circumferential wall 82 and removes heat from the plurality of tube elements 90. Heat removal is desirable due to the high H2 flame anchoring generally very close to circumferential wall 82 and raising temperatures of the plurality of tube elements 90. Accordingly, the exemplary embodiments improve the flashback margin by lowering temperatures at circumferential wall 82 and the plurality of tube elements 90.

Figure 4:
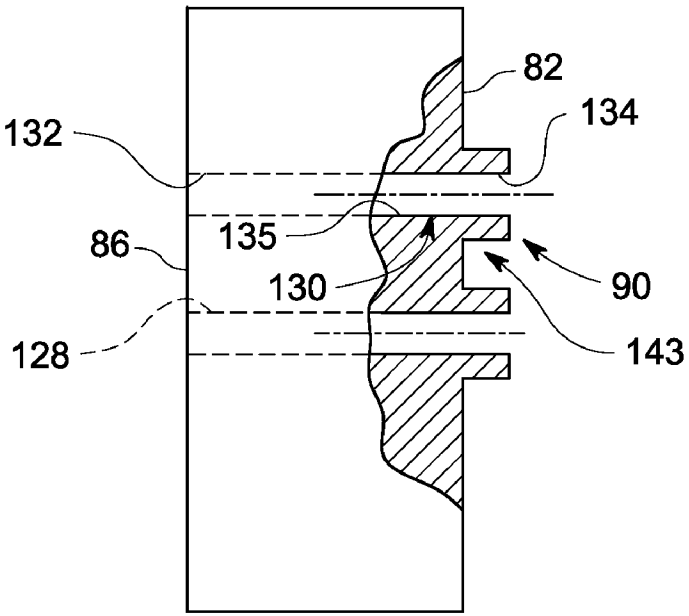
FIG. 4 is a partial detail view of one of the plurality of injection nozzle assemblies of FIG. 3.

As best shown in FIG. 4, tube elements 90 include a body 130 having a first end section or inlet 132 that extends from end wall 86, to a second end section or outlet 134 through an intermediate section 135. Intermediate section 135 includes an opening (not shown) that fluidly connects tube elements 90 with upstream fuel delivery plenum 128. Outlet 134 extends beyond circumferential wall 82 of injection nozzle assembly 38 thereby defining an interface zone 143. In accordance with one aspect of the exemplary embodiment, outlet 134 extends between about 0.1 D to about 1.2 D (where D is an inner diameter of tube element 90) from circumferential wall 82.

In accordance with the exemplary embodiment shown, interface zone 143 is defined by a substantially perpendicular angle between circumferential wall 82 and outlet 134. Extending outlet 134 beyond circumferential wall 82, enables injection nozzle assembly 38 to not only achieve a more complete mixing of fuel and air thereby creating a more stable flame which, in turn, leads to more complete combustion, but also reduces occurrences of flash back. That is, the projecting end portions of tube elements 90 create flow vortices that enhance mixing. The enhanced mixing leads to more complete combustion resulting in lower emissions. The enhanced mixing also substantially limits flashback. In addition, extending outlet 134 beyond circumferential wall 82 forms a mixing region (not separately labeled) at interface zone 143. The mixing region provides a deeper pocket for the fuel and air to accumulate which results in a leaner mixture at circumferential wall 82. This leaner mixture reduces the probability of flashback. By eliminating or reducing the probability of flashback, turbomachine 2 can be operated in a lower turn down mode.

Figure 5:
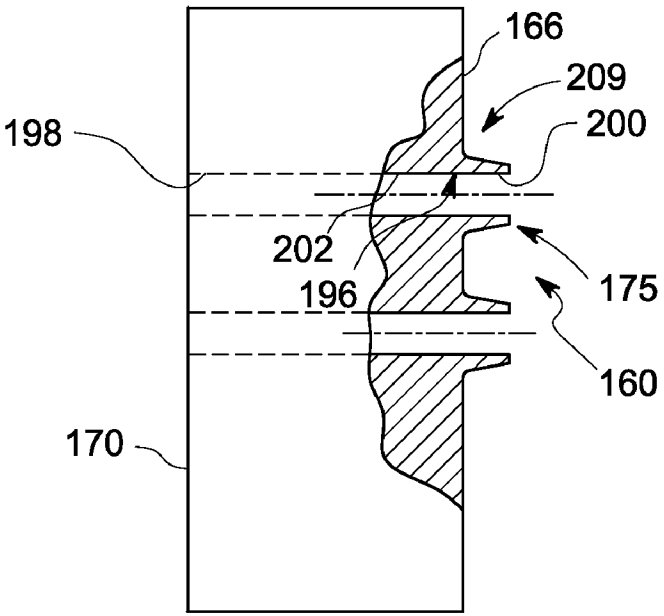
FIG. 5 is a partial detail view of an injection nozzle assembly in accordance with another aspect of the exemplary embodiment.

Reference will now be made to FIG. 5, wherein like reference numbers represent corresponding parts in the respective views, in describing an injection nozzle assembly 160 in accordance with another exemplary embodiment. Injection nozzle assembly 160 includes a first end portion (not shown) that extends to a second end portion or circumferential wall 166 through a plenum (not shown) having an end wall 170. In a manner similar to that described above, injection nozzle assembly 160 also includes a plurality of tube elements, one of which is indicated generally at 175, arranged in a number of rows (not shown) that extend radially about circumferential wall 166.

Tube elements 175 include a body 196 having a first end section or inlet 198 that extends from end wall 170, to a second end section or outlet 200 through an intermediate section 202. Intermediate section 202 includes an opening (not shown) that fluidly connects tube elements 175 with an upstream fuel delivery plenum (not shown). Outlet 200 extends beyond circumferential wall 166 of injection nozzle assembly 160 thereby defining an interface zone 209. In accordance with one aspect of the exemplary embodiment, outlet 200 extends between about 0.1 D to about 1.2 D (where D is an inner diameter of tube element 175) from circumferential wall 166.

In accordance with the exemplary embodiment shown, interface zone 209 is defined by a substantially sloping junction between circumferential wall 166 and outlet 200. More specifically, in the exemplary embodiment shown, circumferential wall 166 includes a substantially planar surface with interface zone 209 creating a gradually sloping connection to outlet 200 of tube elements 175. In a manner similar to that described above, extending outlet 200 beyond circumferential wall 166 enables injection nozzle assembly 160 to not only achieve a more complete mixing of fuel and air thereby creating a more stable flame which, leads to more complete combustion, but also reduces occurrences of flash back. That is, the projecting end portions of tube elements 175 create flow vortices that enhance mixing. The enhanced mixing leads to more complete combustion resulting in lower emissions, and prevents flashback. By eliminating or reducing the probability of flashback, turbomachine 2 can be operated in a lower turn down mode.

Figure 6:
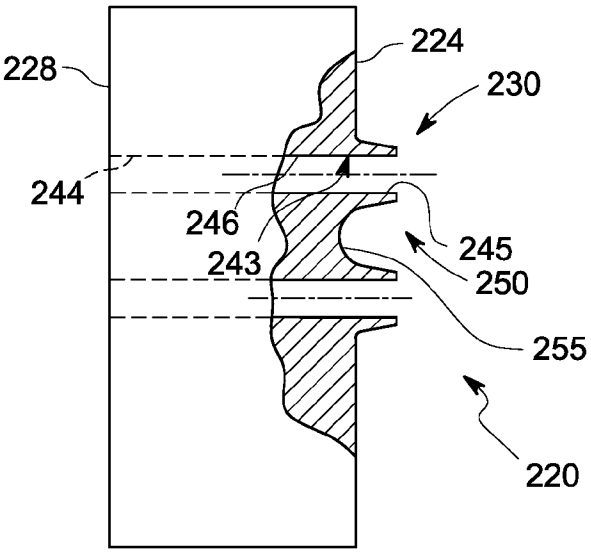
FIG. 6 is a partial detail view of an injection nozzle assembly in accordance with yet another aspect of the exemplary embodiment.

Reference will now be made to FIG. 6, wherein like reference numbers represent corresponding parts in the respective views, in describing an injection nozzle assembly 220 in accordance with another exemplary embodiment. Injection nozzle assembly 220 includes a first end portion (not shown) that extends to a second end portion or circumferential wall 224 through an internal plenum (not shown) having an end wall 228. Injection nozzle assembly 220 also includes a plurality of tube elements, one of which is indicated generally at 230 that are arranged in a number of rows (not shown) that extend radially about circumferential wall 224.

In accordance with an exemplary embodiment illustrated in FIG. 6, tube elements 230 include a body 243 having a first end section or inlet 244 that extends from end wall 228, to a second end section or outlet 245 through an intermediate section 246. Intermediate section 246 includes an opening (not shown) that fluidly connects tube element 230 with upstream fuel delivery plenum (also not shown). Second end section 245 extends beyond circumferential wall 224 of injection nozzle assembly 220 thereby defining an interface zone 250. In accordance with one aspect of the exemplary embodiment, outlet 245 extends between about 0.1 D to about 1.2 D (where D is an inner diameter of tube element 230) from circumferential wall 224.

In accordance with the exemplary embodiment shown, interface zone 250 is defined by a substantially sloping junction between circumferential wall 224 and outlet 245. More specifically, in the exemplary embodiment shown, circumferential wall 224 includes a dimpled surface, e.g., a surface having a plurality of dimples or recessed regions 255 that are present at interstitial regions between each of the plurality of tubes elements 230. In this manner, interface zone 250 creates a gradually sloping connection to outlet 245 of tube element 230. In a manner also similar to that described above, by extending outlet 245 beyond circumferential wall 224 enables injection nozzle assembly 220 to not only achieve a more complete mixing of fuel and air thereby creating a more stable flame which, in turn, leads to more complete combustion, but also reduces occurrences of flash back.

The addition of the plurality of recessed regions about each of the plurality of tube elements provides enhanced fuel circulation that leads to a gradually leaner fuel distribution in a boundary layer region at circumferential wall 224. The leaner fuel distribution further reduces the possibility of flashback at injection nozzle assembly 220. With this arrangement, the fuel cools down circumferential wall 224 and removes heat from the plurality of tube elements 230 through fins (not shown). Heat removal is desirable due to the high H2 flame anchoring generally very close to circumferential wall 224 and raising temperatures of the plurality of tube elements 230. Accordingly, the exemplary embodiments improve flashback margin by lowering temperatures at circumferential wall 224 and the plurality of tube elements 230.

Figure 7:
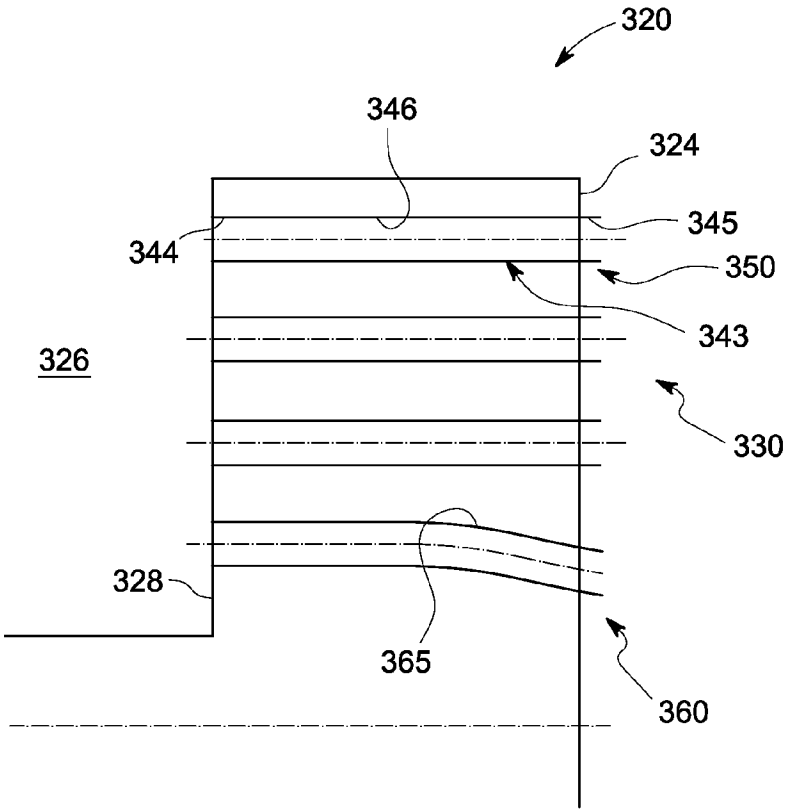
FIG. 7 is a partial detail view of an injection nozzle assembly in accordance with still another aspect of the exemplary embodiment.

Reference will now be made to FIG. 7, wherein like reference numbers represent corresponding parts in the respective views, in describing an injection nozzle assembly 320 in accordance with another exemplary embodiment. Injection nozzle assembly 320 includes a first end portion (not shown) that extends to a second end portion or circumferential wall 324 through an internal plenum 326 having an end wall 328. Injection nozzle assembly 320 also includes a plurality of tube elements, one of which is indicated generally at 330, arranged in a number of rows that extend radially about circumferential wall 324.

In a manner similar to that discussed above, tube elements 330 receive fuel from a fuel inlet tube (not shown) that extends through injection nozzle assembly 320 from end cover 30 (FIG. 2) to a central receiving port (also not shown). Tube elements 330 include a body 343 having a first end section or inlet 344 that extends from end wall 328, to a second end section or outlet 345 through an intermediate section 346. Intermediate section 346 includes an opening (not shown) that fluidly connects tube elements 330 with upstream fuel delivery plenum (also not shown). Outlet 345 extends beyond circumferential wall 324 of injection nozzle assembly 320 thereby defining an interface zone 350. In accordance with one aspect of the exemplary embodiment, outlet 345 extends between about 0.1 D to about 1.2 D (where D is an inner diameter of tube element 330) from circumferential wall 324.

In accordance with the exemplary embodiment shown, interface zone 350 is defined by a substantially perpendicular angle between circumferential wall 324 and outlet 345. In this manner, interface zone 350 establishes a connection with second end section 324 of tube element 330. In a manner also similar to that described above, by extending outlet 345 beyond circumferential wall 324 enables injection nozzle assembly 320 to not only achieves a more complete mixing of fuel and air thereby creating a more stable flame which, in turn, leads to more complete combustion, but also reduces occurrences of flash back. In further accordance with the exemplary aspect shown, injection nozzle assembly 320 includes a plurality of angled tube elements, one of which is indicated generally at 360 arranged in an inner one of the plurality of rows (not separately labeled). Tube elements 360 include an angled region 365. Angled region 365 creates a centralized flame stabilization zone and a leaner flame at first and second rows (not separately labeled) of tube elements 330 in combustion chamber 48 (FIG. 2), which further enhances flame stability leading to more complete combustion and lower emissions.

Figure 8:
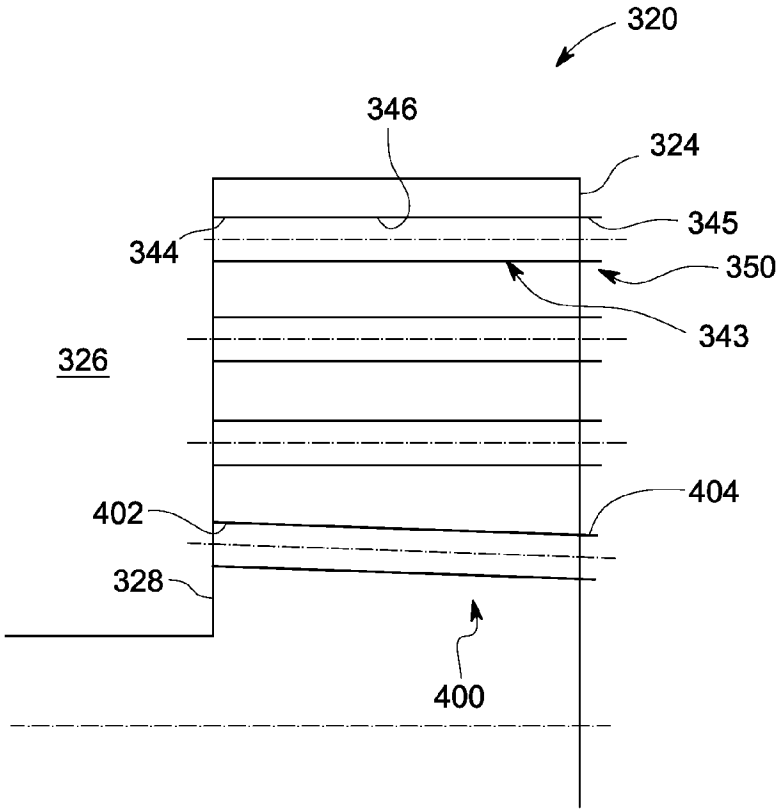
FIG. 8 is a partial detail view of an injection nozzle assembly in accordance with a further aspect of the exemplary embodiment.

In accordance with another exemplary aspect, illustrated in FIG. 8, wherein like reference numbers represent corresponding parts in the respective views, injection nozzle assembly 320 includes a plurality of angled tube elements 400 arranged in the inner most row (not separately labeled) that surrounds central receiving port (not shown). Angled tube elements 400 are angled from a first end section or inlet 402 to a second end section or outlet 404 relative to a longitudinal axis (not separately labeled) of injection nozzle assembly 320. In accordance with one aspect of the exemplary embodiment, angled tube elements 400 are at an angle of less than 20° relative to the longitudinal axis of injection nozzle assembly 320.

Figure 9:
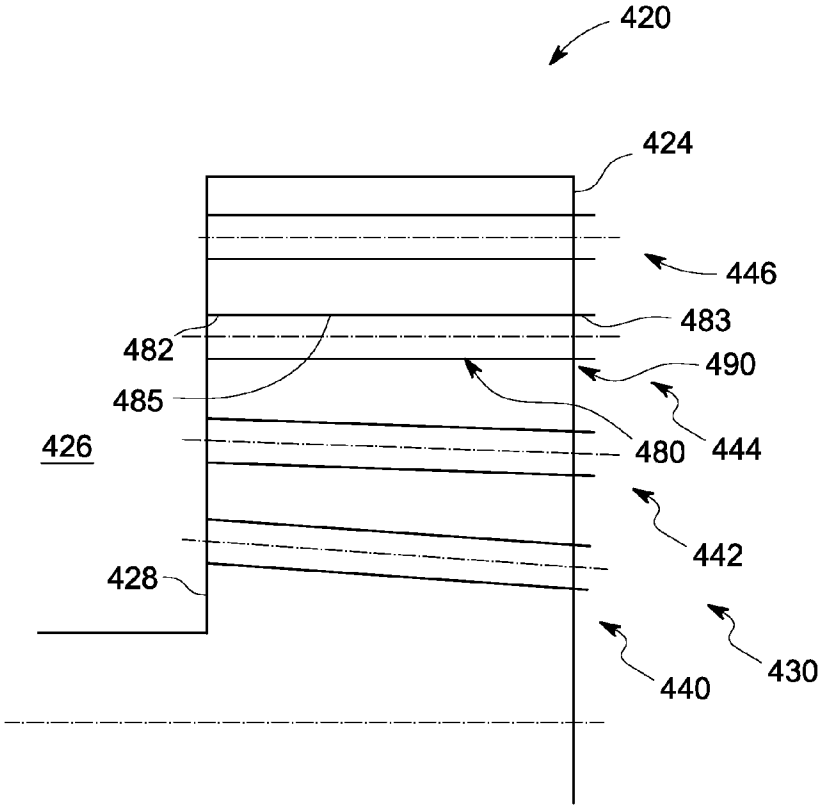
FIG. 9 is a partial detail view of an injection nozzle assembly in accordance with yet a further aspect of the exemplary embodiment.

Reference will now be made to FIG. 9, in describing an injection nozzle assembly 420 in accordance with another exemplary embodiment. Injection nozzle assembly 420 includes a first end portion (not shown) that extends to a second end portion or circumferential wall 424 through an internal plenum 426 having an end wall 428. Injection nozzle assembly 420 also includes a plurality of tube elements 430 arranged circumferentially about a central receiving port (not shown). Tube elements 430 include a first or inner most row 440 arranged about the central receiving port, a second row 442 arranged about first row 440, a third row 444 arranged about second row 442, and a fourth row 446 arranged about third row 444. Of course it should be understood that the number of rows of tube elements 430 could vary. Tube elements 430 in, for example third row 444 include a body 480 having a first end section or inlet 482 that extends from end wall 428, to a second end section or outlet 483 through an intermediate section 485. Intermediate section 485 includes an opening (not shown that fluidly connects tube elements 430 with upstream fuel delivery plenum (also not shown). Second end section 483 extends beyond second end portion 424 of injection nozzle assembly 420 thereby defining an interface zone 490. In accordance with one aspect of the exemplary embodiment, outlet 483 extends between about 0.1 D to about 1.2 D (where D is an inner diameter of tube element 430) from circumferential wall 424.

In accordance with the exemplary embodiment shown, the plurality of tube elements 430 arranged in first row 440 are positioned at a first angle relative to a centerline of injection nozzle assembly 420. In accordance with one aspect of the exemplary embodiment tube elements 430 in first row 440 are at an angle of about 20°. In addition, the plurality of tube elements 430 arranged in second row 442 are arranged at a second angle, that is distinct from the first angle, relative to the centerline of injection nozzle assembly 420. In accordance with the exemplary aspect shown, tube elements 430 in second row 442 are at an angle of about 10°. The angle of first and second rows 440 and 442 creates a centralized flame stabilization zone and a leaner flame at the first, second and third rows 440, 442, and 444 in combustion chamber 48, which further enhances flame stability leading to more complete combustion and lower emissions.

Figure 10:
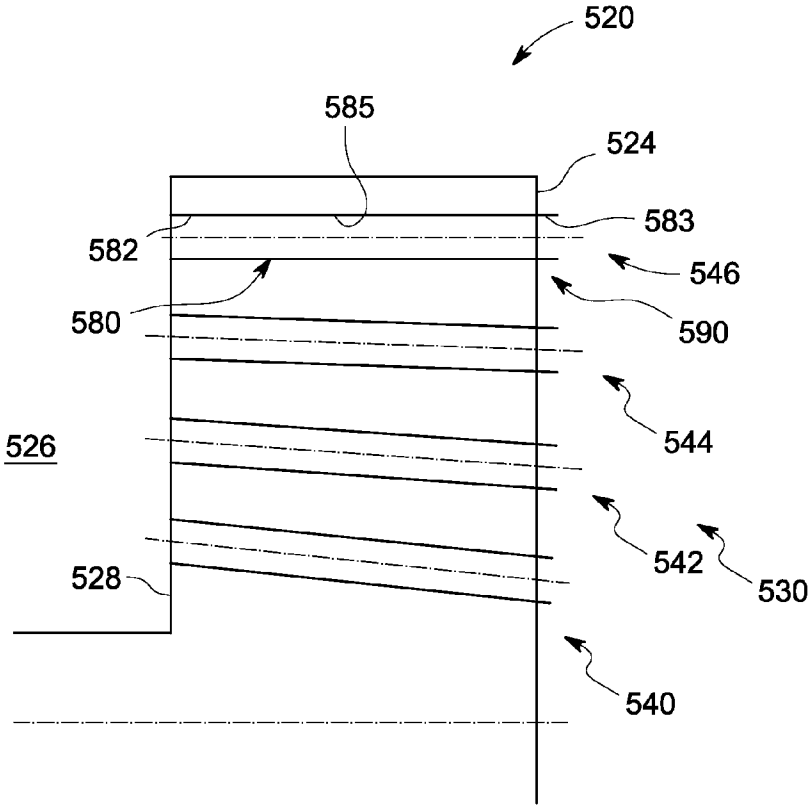
FIG. 10 is a partial detail view of an injection nozzle assembly in accordance with still a further aspect of the exemplary embodiment.

Reference will now be made to FIG. 10, in describing an injection nozzle assembly 520 in accordance with another exemplary embodiment. Injection nozzle assembly 520 includes a first end portion (not shown) that extends to a second end portion or circumferential wall 524 through an internal plenum 526 having an end wall 528. Injection nozzle assembly 520 also includes a plurality of tube elements 530 arranged circumferentially about a central receiving port (not shown). Tube elements 530 include a first or inner most row 540, a second row 542 arranged about first row 540, a third row 544 arranged about second row 542, and a fourth row 546 arranged about third row 544. Of course it should be understood that the number of rows of tube elements 530 could vary. Tube elements 530 in, for example, row 546 include a body 580 having a first end section or inlet 582 that extends from end wall 528, to a second end section or outlet 583 through an intermediate section 585. Intermediate section 585 includes an opening (not shown) that fluidly connects tube elements 530 with upstream fuel delivery plenum (also not shown). Outlet 583 extends beyond second end portion 524 of injection nozzle assembly 520 thereby defining an interface zone 590. In accordance with one aspect of the exemplary embodiment, outlet 583 extends between about 0.1 D to about 1.2 D (where D is an inner diameter of tube element 530) from circumferential wall 524.

In accordance with the exemplary embodiment shown, the plurality of tube elements 530 arranged in first row 540 are positioned at a first angle relative to a centerline of injection nozzle assembly 520. In accordance with one aspect of the exemplary embodiment tube elements 530 in first row 540 are at an angle of about 20°. The plurality of tube elements 530 arranged in second row 542 are arranged at a second angle, that is distinct from the first angle, relative to the centerline of injection nozzle assembly 520. In accordance with the exemplary aspect shown, tube elements 530 in second row 542 are at an angle of about 15°. The plurality of tube elements 530 arranged in third row 544 are arranged at a third angle that is distinct from the first and second angles, relative to the centerline of injection nozzle assembly 520. In accordance with the exemplary aspect shown, tube elements 530 in third row 544 are at an angle of about 10°. The plurality of tube elements 530 arranged in fourth row 546 are arranged at a fourth angle that is distinct from the first, second and third angles, relative to the centerline of injection nozzle assembly 520. In accordance with the exemplary aspect shown, tube elements 530 in fourth row 546 are at an angle of about 5°. The angle of first, second, third and fourth rows 440, 442, 444, and 446 creates a centralized flame stabilization zone and a leaner flame in combustion chamber 48, which further enhances flame stability leading to more complete combustion and lower emissions.

At this point it should be understood that the exemplary embodiments provide an injection nozzle assembly having tube elements that extend beyond a hot face of the injection nozzle. Extending the tube elements beyond the hot face not only achieves a more complete mixing of fuel and air but also reduces occurrences of flash back. More complete combustion leads to fewer NOx emissions while reducing flashback enables the turbomachine to be operated in a turn down mode that is lower than currently possible. In turn down, flow velocities are lower which tend to create flashback conditions. By creating a leaner mixture at end portions of the injection nozzle, flash back conditions are reduced allowing the turbomachine to be operated in a lower turn down mode to further enhance fuel savings.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor;

a combustor operatively connected to the compressor, the combustor including a combustion chamber;

an end cover mounted to the combustor;

an injection nozzle assembly operatively connected to the combustor, the injection nozzle assembly including a first end portion that extends to a second end portion, and a plurality of tube elements provided at the second end portion, each of the plurality of tube elements defining a fluid passage including a body having a first end section that extends from the first end portion to a second end section, the second end section projecting beyond the second end portion of the injection nozzle assembly into the combustion chamber; and a central receiving port arranged in the injection nozzle assembly, the plurality of tube elements being arranged in a plurality of rows that extend circumferentially about the central receiving port.

2. The turbomachine according to claim 1, further comprising: an interface zone positioned between the second end portion of the injection nozzle assembly and the second end section of each of the plurality of tube elements.

3. The turbomachine according to claim 2, wherein the interface zone defines a substantially perpendicular angle between the second end portion of the injection nozzle assembly and the second end section of each of the plurality of tube elements.

4. The turbomachine according to claim 2, wherein the interface zone defines a sloping connection between the second end portion of the injection nozzle assembly and the second end section of each of the plurality of tube elements.

5. The turbomachine according to claim 1, further comprising: a plurality of recessed regions formed in the second end portion of the injection nozzle assembly, the plurality of recessed regions being positioned at interstitial regions between adjacent ones of the plurality of tube elements.

6. The turbomachine according to claim 1, wherein the plurality of rows including a first row arranged directly adjacent the central receiving port, a second row arranged about the first row, a third row arranged about the second row, a fourth row arranged about the third row and a fifth row arranged about the fourth row.

7. The turbomachine according to claim 6, wherein each of the plurality of tube elements arranged in the first row includes an angled region, the angled region being angled relative to the plurality of tube elements in others of the plurality of rows.

8. The turbomachine according to claim 7, wherein the angled region is arranged within the injection nozzle assembly.

9. The turbomachine according to claim 6, wherein each of the plurality of tube elements arranged the first row is angled relative to a longitudinal axis of the injection nozzle assembly.

10. The turbomachine according to claim 6, wherein each of the plurality of tube elements arranged in the first row is arranged at a first angle, and each of the plurality of tube elements arranged in the second row is arranged at a second angle, the second angle being distinct from the first angle.

11. The turbomachine according to claim 10, wherein each of the plurality of tube elements arranged in the first row are at an angle of about 20° relative to a centerline of the injection nozzle assembly, and each of the plurality of tube elements arranged in the second row are at an angle of about 10° relative to a centerline of the injection nozzle assembly.

12. The turbomachine according to claim 10, wherein each of the plurality of tube elements arranged in the third row is arranged at a third angle, the third angle being distinct from the first and second angles, and each of the plurality of tube elements arranged in the fourth row is arranged at a fourth angle, the fourth angle being distinct from the first, second, and third angles.

13. The turbomachine according to claim 12, wherein each of the plurality of tube elements arranged in the first row are at an angle of about 20° relative to a centerline of the injection nozzle assembly, each of the plurality of tube elements arranged in the second row are at an angle of about 15° relative to a centerline of the injection nozzle assembly, each of the plurality of tube elements arranged in the third row are at an angle of about 10°, and each of the plurality of tube elements arranged in the fourth row are at an angle of about 5°.

14. The turbomachine according to claim 1, further comprising: at least one opening arranged in each of the plurality of tube elements, the at least one opening fluidly connecting corresponding ones of the plurality of tube elements with a fluid plenum in the injection nozzle assembly.

15. An injection nozzle assembly for a turbomachine, the injection nozzle assembly including:

a first end portion that extends to a second end portion;

a plurality of tube elements provided at the second end portion, each of the plurality of tube elements defining a fluid passage including a body having a first end section that extends to a second end section, the second end section projecting beyond the second end portion of the injection nozzle assembly, the second end portion being configured to extend into a combustion chamber of a combustor; and a central receiving port arranged in the injection nozzle assembly, the plurality of tube elements being arranged in a plurality of rows that extend circumferentially about the central receiving port.

16. The injection nozzle assembly according to claim 15, further comprising: an interface zone positioned between the second end portion of the injection nozzle assembly and the second end section of each of the plurality of tube elements.

17. The injection nozzle assembly according to claim 16, wherein the interface zone defines a substantially perpendicular angle between the second end portion of the injection nozzle assembly and the second end section of each of the plurality of tube elements.

18. The injection nozzle assembly according to claim 16, wherein the interface zone defines a sloping connection between the second end portion of the injection nozzle assembly and the second end section of each of the plurality of tube elements.

19. The injection nozzle assembly according to claim 15, further comprising: a plurality of recessed regions formed in the second end portion of the injection nozzle assembly, the plurality of recessed regions being positioned at interstitial regions between adjacent ones of the plurality of tube elements.

20. The injection nozzle assembly according to claim 15, wherein, the plurality of tube elements being arranged in a plurality of rows that extend circumferentially about the central receiving port, the plurality of rows include a first row arranged directly adjacent the central receiving port, a second row arranged about the first row, a third row arranged about the second row, a fourth row arranged about the third row and a fifth row arranged about the fourth row.

21. The injection nozzle assembly according to claim 20, wherein each of the plurality of tube elements arranged in the first row includes an angled region, the angled region being angled relative to the plurality of tube elements in others of the plurality of rows.

22. The injection nozzle assembly according to claim 21, wherein the angled region is arranged within the injection nozzle assembly.

23. The injection nozzle assembly according to claim 20, wherein each of the plurality of tube elements arranged in the first row is angled relative to a longitudinal axis of the injection nozzle assembly.

24. The injection nozzle assembly according to claim 20, wherein each of the plurality of tube elements arranged in the first row is arranged at a first angle, and each of the plurality of tube elements arranged in the second row is arranged at a second angle, the second angle being distinct from the first angle.

25. The injection nozzle assembly according to claim 24, wherein each of the plurality of tube elements arranged in the first row are at an angle of about 20° relative to a centerline of the injection nozzle assembly, and each of the plurality of tube elements arranged in the second row are at an angle of about 10° relative to a centerline of the injection nozzle assembly.

26. The injection nozzle assembly according to claim 24, wherein each of the plurality of tube elements arranged in the third row is arranged at a third angle, the third angle being distinct from the first and second angles, and each of the plurality of tube elements arranged in the fourth row is arranged at a fourth angle, the fourth angle being distinct from the first, second, and third angles.

27. The injection nozzle assembly according to claim 26, wherein each of the plurality of tube elements arranged in the first row are at an angle of about 20° relative to a centerline of the injection nozzle assembly, each of the plurality of tube elements arranged in the second row are at an angle of about 15° relative to a centerline of the injection nozzle assembly, each of the plurality of tube elements arranged in the third row are at an angle of about 10°, and each of the plurality of tube elements arranged in the fourth row are at an angle of about 5°.

28. The injection nozzle assembly according to claim 15, further comprising: at least one opening arranged in each of the plurality of tube elements, the at least one opening fluidly connecting corresponding ones of the plurality of tube elements with a fluid plenum arranged within the injection nozzle assembly.

* * * * *